US009103045B2

(12) United States Patent
Zhou et al.

(10) Patent No.: US 9,103,045 B2
(45) Date of Patent: Aug. 11, 2015

(54) DEVICE AND METHOD FOR COLORING ANODE COATINGS USING THE COLORING DEVICE

(71) Applicants: SHENZHEN FUTAIHONG PRECISION INDUSTRY CO., LTD., Shenzhen (CN); FIH (Hong Kong) Limited, Kowloon (HK)

(72) Inventors: Shu-Xiang Zhou, Shenzhen (CN); Chia-Wen Tsao, New Taipei (TW)

(73) Assignees: SHENZHEN FUTAIHONG PRECISION INDUSTRY CO., LTD., Shenzhen (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 14/197,174

(22) Filed: Mar. 4, 2014

(65) Prior Publication Data

US 2014/0186552 A1 Jul. 3, 2014

Related U.S. Application Data

(62) Division of application No. 13/443,487, filed on Apr. 10, 2012, now Pat. No. 8,707,895.

(30) Foreign Application Priority Data

Dec. 16, 2011 (CN) ..... 2011 1 04232894

(51) Int. Cl.

| | |
|---|---|
| ***B05D 5/06*** | (2006.01) |
| ***C25D 5/00*** | (2006.01) |
| ***C25D 7/00*** | (2006.01) |
| ***C25D 17/00*** | (2006.01) |
| ***C25D 21/12*** | (2006.01) |

(52) U.S. Cl.

CPC *C25D 5/006* (2013.01); *B05D 5/06* (2013.01); *C25D 7/001* (2013.01); *C25D 17/007* (2013.01); *C25D 21/12* (2013.01)

(58) Field of Classification Search

CPC ..... C25D 5/006; B05D 5/06

See application file for complete search history.

(56) References Cited

U.S. PATENT DOCUMENTS

| | | | | |
|---|---|---|---|---|
| 4,201,635 | A * | 5/1980 | Muller | 205/339 |
| 4,338,169 | A * | 7/1982 | Bienvenu | 75/10.67 |
| 2011/0177590 | A1* | 7/2011 | Clyne et al. | 435/325 |

* cited by examiner

*Primary Examiner* — Ramon Barrera

(74) *Attorney, Agent, or Firm* — Novak Druce Connolly Bove + Quigg LLP

(57) ABSTRACT

A device for applying a magnetic field to a container comprises an adjustable magnetic field generator. The adjustable magnetic field generator is adjacent to the container and has a magnet having one magnetic pole adjacent a wall of the container and another magnetic pole away from the wall of the container. The adjustable magnetic field generator comprises a magnet. The intensity of magnetic field applied to the container gradually decreases from the container wall adjacent the magnetic pole of the magnet to the opposite container wall. Method for coloring anode coatings using the coloring device is also provided.

9 Claims, 2 Drawing Sheets

DEVICE AND METHOD FOR COLORING ANODE COATINGS USING THE COLORING DEVICE

CROSS-REFERENCE TO RELATED APPLICATION

This application is a divisional application of U.S. Ser. No. 13/443,487, filed Apr. 10, 2012 the contents of which are hereby incorporated by reference. The patent application Ser. No. 13/443,487 in turn claims the benefit of priority under 35 USC 119 from Chinese Patent Application 201110423289.4, filed on Dec. 16, 2011.

BACKGROUND

1. Technical Field

The present disclosure relates to a device and a method for coloring anode coatings using the coloring device.

2. Description of Related Art

Anode coatings are usually colored using a coloration treatment. After the coloration treatment, partial regions of the anode coating may be un-evenly faded and allow the anode coating to present a gradually changing color. Fading the color of the anode coating may be carried out using an automatic lift-and-lower equipment to control the dipping times of different regions of the anode coating in a fading solution. However, the automatic lift-and-lower equipment is expensive. Furthermore, the fading treatment prolongs the whole process.

Therefore, there is room for improvement within the art.

BRIEF DESCRIPTION OF THE FIGURES

Many aspects of the disclosure can be better understood with reference to the following figures. The components in the figures are not necessarily drawn to scale, the emphasis instead being placed upon clearly illustrating the principles of the disclosure. Moreover, in the drawings like reference numerals designate corresponding parts throughout the several views.

DETAILED DESCRIPTION

Figure 1:
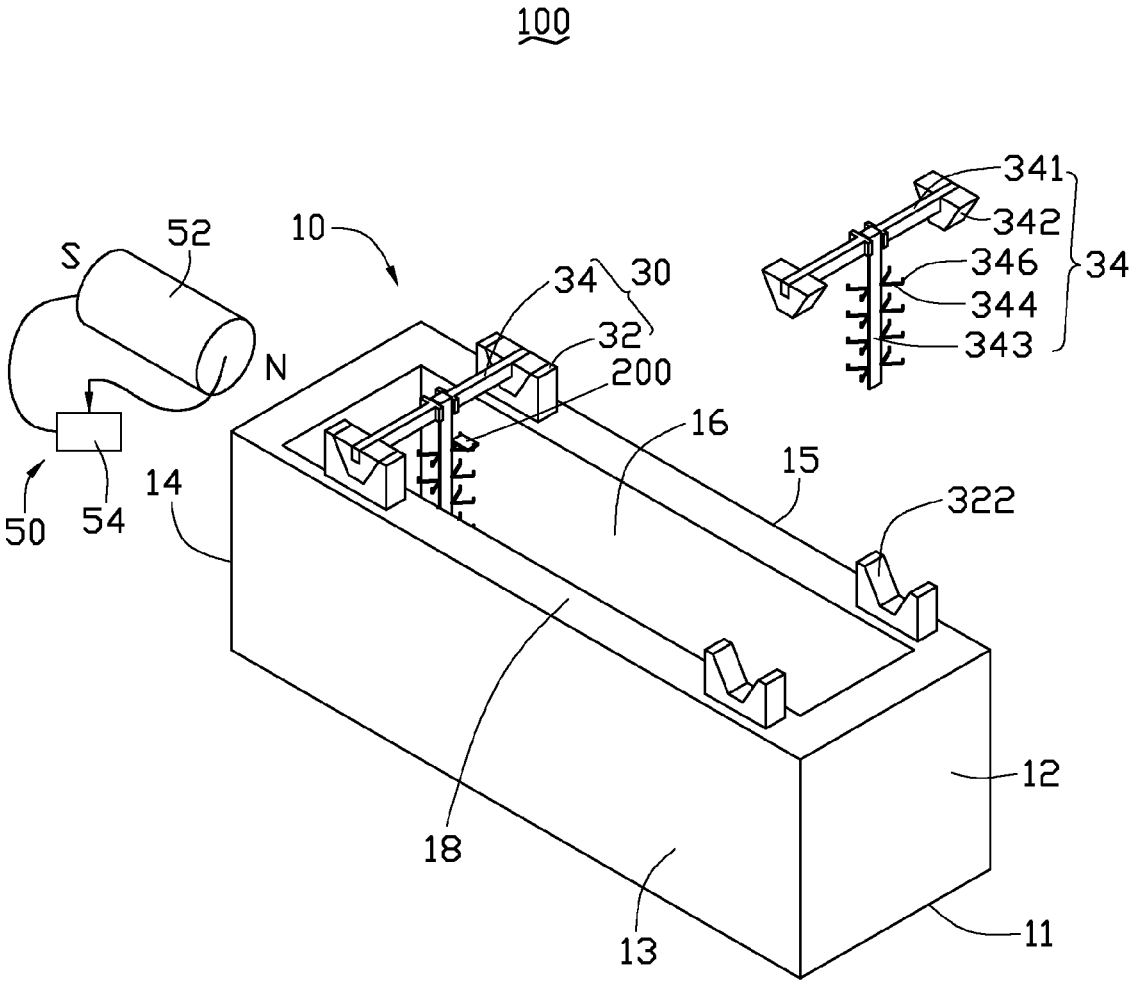
FIG. 1 is an isometric view of an exemplary embodiment of a device.

FIG. 1 shows a device 100 according to an exemplary embodiment. The coloring device 100 includes a container 10, a supporting structure 30, and an adjustable magnetic field generator 50. The supporting structure 30 is detachably fixed to the container 10. The adjustable magnetic field generator 50 is adjacent to the container 10.

The container 10 includes a base board 11 and a first sidewall 12, a second sidewall 13, a third sidewall 14 and a fourth sidewall 15 vertically extending from the periphery of the base board 11. The base board 11 and the four sidewalls cooperatively define a cavity 16 of the container 10. The cavity 16 contains coloration solutions for coloring workpiece 200 having an anode coating (the anode coating is not shown).

The supporting structure 30 is for supporting the workpiece 200. The supporting structure 30 includes at least two opposite fastening blocks 32 and at least one bracket 34. The two opposite fastening blocks 32 are respectively secured on the top surfaces 18 of the second sidewall 13 and the fourth sidewall 15.

Each fastening block 32 defines a latching groove 322. The bracket 34 is latched in the latching grooves 322 of the two opposite fastening blocks 32.

The bracket 34 includes a connecting rod 341, two latching portions 342, a main rod 343 vertically connected with the connecting rod 342, a plurality of elastic portions 344, and a plurality of hooks 346. The two opposite ends of the connecting rod 341 are respectively secured in the two latching portions 342. Each latching portion 342 matches each latching groove 322 to detachably mount the bracket 34 to the fastening block 32.

The elastic portions 344 are fixed to the main rod 343. Two hooks 346 are defined on the two opposite ends of each elastic portion 344. During coloring, the workpiece 200 may be supported by each two adjacent elastic portions 344 at the same side of the main rod 343 and clasped by each two hooks 346 that are defined on the elastic portions 344.

The adjustable magnetic field generator 50 adjusts the intensity of a magnetic field applied to the container 10. The adjustable magnetic field generator 50 includes a magnet 52 substantially perpendicular and adjacent to the exterior surface of one of the sidewalls 12, 13, 14, 15, and a rheostat 54 electrically connected to the magnet 52. The rheostat 54 adjusts the galvanic current through the adjustable magnetic field generator 50 to control and adjust the intensity of the magnetic field generated by the magnet 52.

The magnet 52 has one magnetic pole adjacent one of the sidewalls 12, 13, 14, 15 and another magnetic pole away from the sidewall of the container 10 to allow the intensity of magnetic field applied to the container 10 to gradually decrease from the sidewall adjacent the magnetic pole of the magnet 52 to the opposite sidewall. When a coloration solution containing magnetic pigment is held in the container 10, the concentration of the magnetic pigment will gradually decrease from the sidewall adjacent the magnetic pole of the magnet 52 to the opposite sidewall under the decreasing intensity of magnetic field of the magnet 52 as applied to container 10. Thus the workpiece 200 colored by the coloration solution in the container 10 presents a gradual color changing appearance.

Figure 2:
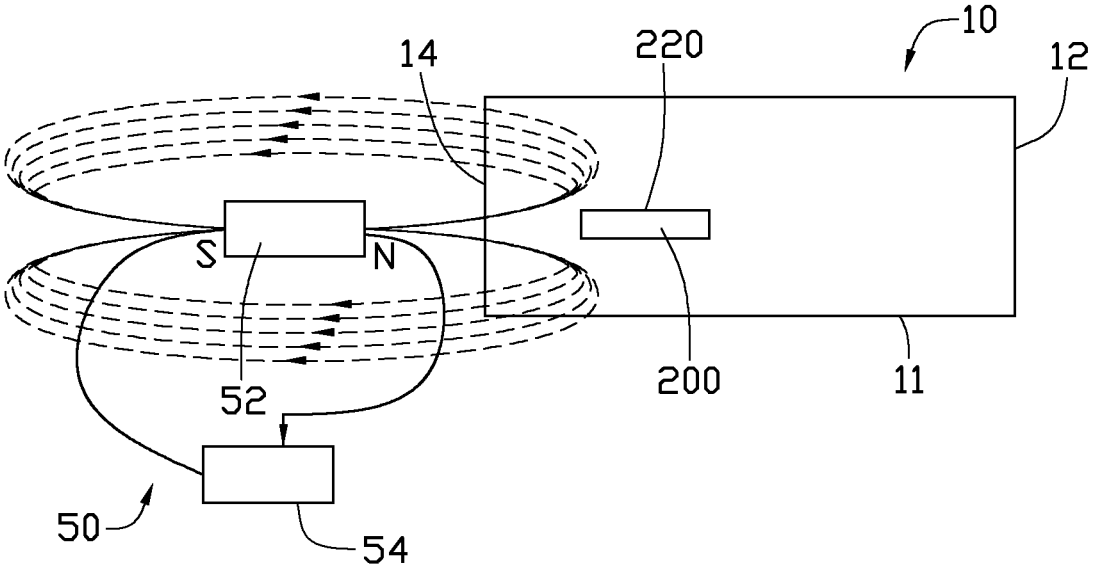
FIG. 2 is a schematic view of the magnetic line of force of a magnet shown in FIG. 1.

In this embodiment, FIG. 2, shows the magnet 52 includes a north magnetic pole and a south magnetic pole. The magnet 52 is parallel to the base board 11. The north magnetic pole of the magnet 52 is adjacent to the exterior surface of the third sidewall 14. The south magnetic pole is located away from the container 10 as compared with the north magnetic pole. The intensity of the magnetic field applied to the container 10 gradually decreases from the third sidewall 14 to the first sidewall 12. The magnetic force lines of the magnet 52 from the north magnetic pole pass through the third sidewall 14, the opening of the container 10 or the base board 11, and return to the south magnetic pole to form an enclosed magnetic field.

In other embodiments, the south magnetic pole of the magnet 52 is adjacent to the exterior surface of the third sidewall 14, and the north magnetic pole is located away from the container 10.

The magnet 52 can also be located near the base board 11 and is not parallel to the base board 11.

A method for coloring anode coating using the device 100 may include the following steps:

The device 100 is provided.

A coloration solution containing magnetic pigment is provided. The coloration solution is held in the container 10. The magnetic pigment is suspended in the coloration solution. In the embodiment, the magnetic pigment is $Fe_3O_4$ particles attached with pigment. The $Fe_3O_4$ particles have a diameter in a range of about 40 nm to about 120 nm. The coloration solution further includes water soluble organic substance such as polyethylene oxide (PEO), polyvinyl pyrrolidone (PVP), and vinyl acetate and hexadecyl trimethyl ammonium bromide (CTAB), which adjust the viscosity of the coloration solution to make the magnetic pigment suspend in the coloration solution rather than floating on the coloration solution or depositing on the base board 11.

The workpiece 200 is provided. The workpiece 200 may be made of Al, Al alloy, Ti, Ti alloy, Mg or Mg alloy. The workpiece 200 includes a surface 220 coated with an anode coating.

The workpiece 200 is colored. The bracket 34 fixed with the workpiece 200 is clasped in the two fastening blocks 32 to immerse the workpieces 200 in the coloration solution. The workpieces 200 are parallel to the base board 11. A power is applied to the device 100. The intensity of magnetic field applied to the container 10 gradually decreases from the sidewall adjacent the magnetic pole of the magnet 52 to the opposite sidewall. The concentration of the magnetic pigment gradually decreases from the sidewall adjacent the magnetic pole of the magnet 52 to the opposite sidewall. The workpiece 200 colored by the coloration solution in the container 10 presents a gradually color changing appearance The intensity of the magnetic field of the container 10 can also be gradually adjusted using the rheostat 54 to adjust the intensity of the magnetic field of the magnet 52, and/or by changing the position of the magnet 52 relative to the container 10.

The device 100 has a simple structure, and is easy to operate.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A method for coloring anode coatings, comprising:

providing a coloring device, the coloring device comprising a container and an adjustable magnetic field generator for adjusting the intensity of a magnetic field applied to the container, the adjustable magnetic field generator being positioned adjacent to the container and having a magnet positioned outside of the container, the magnet having one magnetic pole adjacent a wall of the container and another magnetic pole facing away from the wall of the container;

providing a coloration solution containing magnetic pigment, the coloration solution held in the container;

providing a workpiece, the workpiece comprising a surface coated with an anode coating;

coloring the workpiece by immersing the workpiece in the coloration solution and gradually decreasing the intensity of magnetic field applied to the container from the container wall adjacent the magnetic pole of the magnet to the opposite container wall by the adjustable magnetic field generator.

2. The coloring method of claim 1, further comprising suspending the magnetic pigment in the coloration solution.

3. The coloring method of claim 2, wherein the magnetic pigment comprises $Fe_3O_4$ particles attached with pigment.

4. The coloring method of claim 3, wherein the magnetic pigment has a diameter of about 40 nm to about 120 nm.

5. The coloring method of claim 1, wherein the coloration solution further comprises water soluble organic substance.

6. The coloring method of claim 5, wherein the water soluble organic substance is polyethylene oxide, polyvinyl pyrrolidone, vinyl acetate or hexadecyl trimethyl ammonium bromide.

7. The coloring method of claim 1, wherein the adjustable magnetic field generator comprises a rheostat electrically connected to the magnet, the rheostat adjusts the galvanic current through the adjustable magnetic field generator to adjust the intensity of magnetic field.

8. The coloring method of claim 7, wherein the magnet comprises a north magnetic pole and a south magnetic pole, one of the north or south magnetic pole is adjacent to the container, the other of the north or south magnetic pole is located away from the container, the intensity of magnetic field applied to the container gradually decreases from the container wall adjacent the magnetic pole of the magnet to the opposite container wall.

9. The coloring method of claim 7, wherein the container comprises a base board and a first sidewall, a second sidewall, a third sidewall and a fourth sidewall vertically extending from the periphery of the base board.

* * * * *